US007201711B2

(12) United States Patent
Towley, III et al.

(10) Patent No.: US 7,201,711 B2
(45) Date of Patent: Apr. 10, 2007

(54) BARBELL USING SELECTORIZED DUMBBELLS AS EXERCISE MASS

(75) Inventors: Carl K. Towley, III, Alexandria, MN (US); Gregory S. Olson, Owatonna, MN (US)

(73) Assignee: Intellex, Inc., Owatonna, MN (US)

( * ) Notice: Subject to any disclaimer, the term of this patent is extended or adjusted under 35 U.S.C. 154(b) by 390 days.

(21) Appl. No.: 10/367,118

(22) Filed: Feb. 14, 2003

(65) Prior Publication Data

US 2004/0162197 A1 Aug. 19, 2004

(51) Int. Cl.
*A63B 21/072* (2006.01)
*A63B 21/075* (2006.01)

(52) U.S. Cl. ..... 482/107; 482/106

(58) Field of Classification Search ..... 482/106–108, 482/104, 93–97, 100
See application file for complete search history.

(56) References Cited

U.S. PATENT DOCUMENTS

| | | | | |
|---|---|---|---|---|
| 1,366,200 | A | | 1/1921 | Matysek |
| 3,756,597 | A | | 9/1973 | Monti |
| 4,029,312 | A | | 6/1977 | Wright |
| 4,252,316 | A | | 2/1981 | Price |
| 4,529,198 | A | | 7/1985 | Hettick, Jr. |
| 4,822,034 | A | * | 4/1989 | Shields ..... 482/106 |
| 5,102,124 | A | * | 4/1992 | Diodati ..... 482/107 |
| 5,496,243 | A | * | 3/1996 | Allen ..... 482/106 |
| 5,637,064 | A | | 6/1997 | Olson et al. |
| 5,839,997 | A | * | 11/1998 | Roth et al. ..... 482/107 |
| 5,879,274 | A | | 3/1999 | Mattox |

OTHER PUBLICATIONS

Power Block Workout Manual, Feb. 1995, pp. 11-13.

* cited by examiner

*Primary Examiner*—Jerome Donnelly
*Assistant Examiner*—Fenn C. Mathew
(74) *Attorney, Agent, or Firm*—James W. Miller

(57) ABSTRACT

A barbell comprises a bar with a receptacle at each end of the bar. The receptacle is configured to receive a selectorized dumbbell therein. The dumbbell is placed into the receptacle in a first loaded condition with a plurality of weights being coupled to the dumbbell. After such placement, the dumbbell can be adjusted to a second loaded condition in which the dumbbell carries fewer weights than in the first loaded condition. The dumbbell is then removed from the receptacle while in the second loaded condition to thereby leave behind at least one weight in the receptacle. Alternatively, the dumbbell in its first loaded condition can simply be left in its entirety in the receptacle. A lock can be provided on the receptacle to help retain within the receptacle either the dumbbell or the weights left behind in the receptacle. Thus, at least portions of selectorized dumbbells provide exercise mass for the barbell.

28 Claims, 10 Drawing Sheets

BARBELL USING SELECTORIZED DUMBBELLS AS EXERCISE MASS

TECHNICAL FIELD

This invention relates to a barbell that uses a pair of dumbbells, or at least portions of a pair of dumbbells, as exercise mass on each end of the bar of the barbell. More particularly, this invention relates to such a barbell that uses selectorized dumbbells having selectors for varying the number of weights carried on the dumbbell to adjust the exercise mass provided on each end of the bar of the barbell, and to methods of using such dumbbells to provide exercise mass on each end a barbell.

BACKGROUND OF THE INVENTION

Weight training is a well known form of anaerobic exercise used primarily to increase muscle tone and strength. Weight training involves performing various exercises against resistance provided by an exercise mass. Various pieces of equipment have been developed and are well known for use in weight training. For example, barbells and dumbbells can be loaded with a desired number of weights and are then lifted by a user in various weight training exercises, e.g. chest presses, biceps curls, etc.

Traditionally, barbells and dumbbells simply comprised an elongated bar which could hold a desired number of weights on either end of the bar. Each weight typically comprised a circular plate having a hole in the middle to allow the weight to be slid onto and off of the bar. To adjust the weight on the barbell or the dumbbell, the user added or removed weights from each end of the bar until each end of the bar carried the desired number of weights. If the user wanted to change or adjust the weight frequently, this required the user to constantly be taking weights off of or putting weights on each end of the bar and then securing the weights in place. Since this is somewhat in-convenient and time consuming to do, the user might be tempted to forego a desired weight adjustment and use the barbell or dumbbell as is even though the weight carried by the barbell or dumbbell might not be the optimum weight for the particular exercise the user was about to perform.

The invention of the selectorized dumbbell by the Applicants was a step forward in weight training equipment. In a selectorized dumbbell, a selector is provided which can be moved by the operator between different positions to "select" or couple different numbers of weights to the handle of the dumbbell. After a particular selection is made and the user lifts the dumbbell, the handle carries with it only the weights selected by the user leaving behind the other weights in a rack or stand. The weights are nested together in the rack or stand and form a pair of spaced apart stacks of weight plates. The handle is dropped down between the stacks of weight plates prior to a weight selection operation. One type of selectorized dumbbell is shown in U.S. Pat. No. 5,637,064 issued to the Applicants hereof.

A trend in the exercise industry is to combine aerobic exercise with weight training for maximum benefit. Many gyms or fitness centers offer classes in which aerobic exercise might be done using a step that the user steps up onto and then down off of. This might then be followed by the user lifting a barbell in a chest or shoulder press exercise and then a dumbbell in a biceps curl exercise. Both barbells and dumbbells are desirably used because they each exercise different muscle groups in different ways.

However, in such combined aerobic/weight training classes, there may be up to 20 or 30 participants. Each participant might require different weights on the barbells and dumbbells during the weight training portion of the classes. Thus, there clearly is a logistical problem in having the exercise space accommodate all the needed equipment, i.e. steps, dumbbells, and barbells and their associated weights, for all the participants. Using selectorized dumbbells as described above can help since they are more compact and the weight carried by the dumbbell can be more quickly and easily adjusted. Nonetheless, this does not help the situation with respect to barbells whose weight is still adjusted in the traditional manner by adding or removing weights from each end of the bar.

Thus, a need exists for a barbell which can have its weight quickly and easily adjusted much like that of a selectorized dumbbell. In addition, it would be desirable that such a barbell not use a plurality of weights on each end of the bar, thus perhaps obviating the need for maintaining a separate supply of such weights. These needs are not confined to the large group exercise situation described earlier, but are also felt by an individual or family user. It would be a boon to any user to get the most versatility and flexibility possible from the user's weight training equipment, thus decreasing the amount of equipment the user needs to purchase and to store.

SUMMARY OF THE INVENTION

One aspect of this invention relates to a barbell for weight training adapted to use at least portions of dumbbells as exercise mass. Each dumbbell includes a handle having at least one weight plate carried on either end of the handle. The barbell comprises a bar elongated along an axis. A receptacle is carried at each end of the bar. Each receptacle has a length which is long enough to permit a dumbbell including the handle and the weight plates carried on the handle to be placed into and received within the length of the receptacle.

Another aspect of this invention relates to a barbell for weight training which comprises a bar. Each end of the bar is configured to detachably receive at least portions of a selectorized dumbbell as exercise mass on each end of the bar.

An additional aspect of this invention relates to a barbell for weight training which comprises a bar. A substantially U-shaped receptacle is carried on each end of the bar. Each receptacle comprises a pair of spaced apart end walls connected together by a bottom wall. Each receptacle has an open upper end. The end walls of each receptacle are spaced apart from one another sufficiently far to accommodate a plurality of weight plates to be received between the end walls with each weight plate when so received being parallel to the end walls and resting on the bottom wall. The number of weight plates received in each receptacle can be selectively varied by the user to provide each end of the bar with a variable exercise mass.

Another aspect of this invention relates to a method for providing exercise mass on each end of a barbell. The method comprises providing selectorized dumbbells each having a plurality of weights with a selector for allowing the dumbbell to carry a desired number of weights. The method further comprises providing an elongated bar for use as a barbell, the bar having a receptacle at either end for receiving a selectorized dumbbell within the receptacle such that a selectorized dumbbell may be placed in the receptacle at either end of the bar. Finally, the method also comprises configuring each selectorized dumbbell in a first loaded condition having a desired number of weights, depositing each selectorized dumbbell as so configured into a receptacle, and leaving at least a portion of each selectorized dumbbell in each receptacle to provide an exercise mass on each end of the bar.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
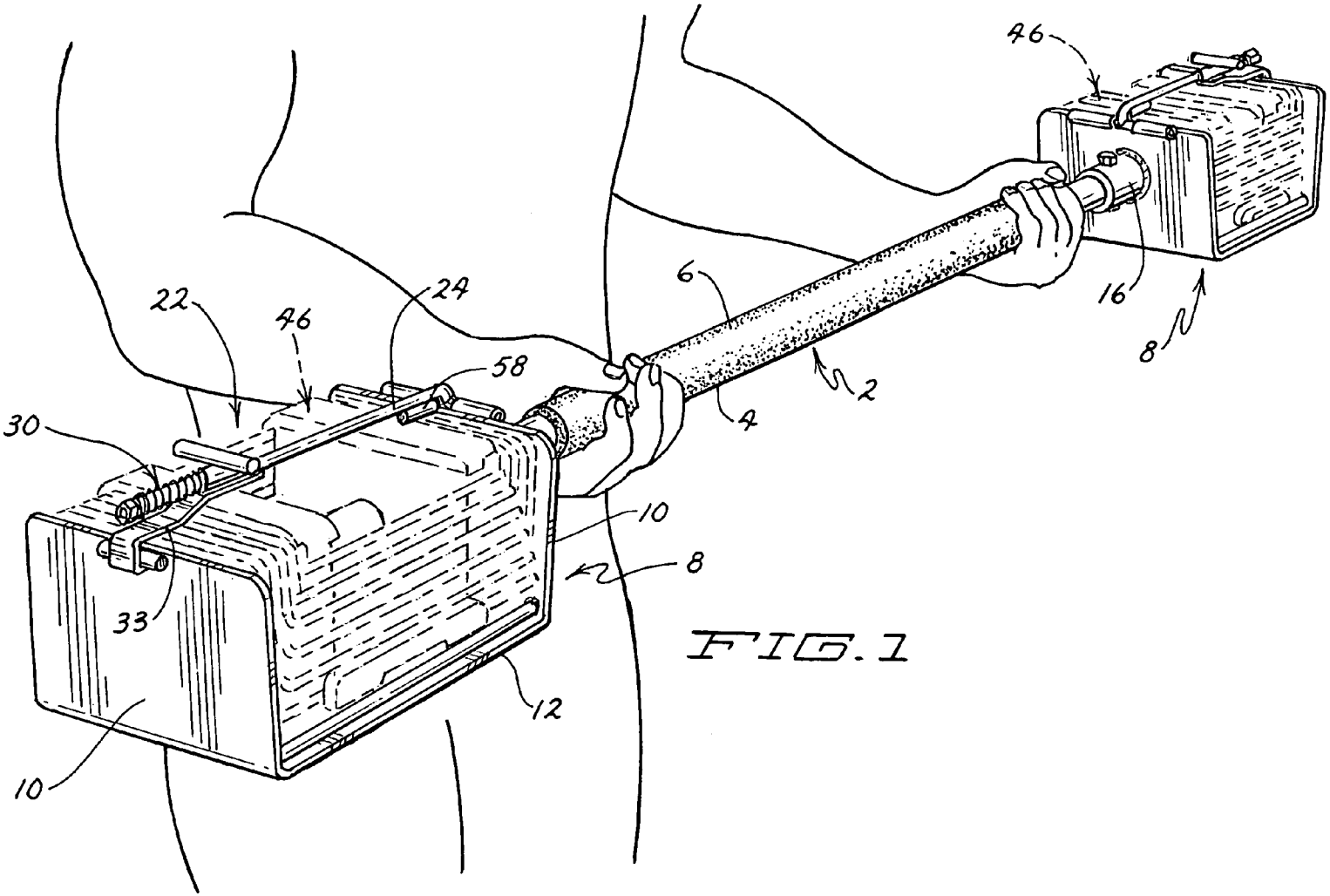
FIG. 1 is a perspective view of a first embodiment of a barbell according to this invention, particularly illustrating selectorized dumbbells carried in the receptacles at the ends of the bar and also particularly illustrating one type of lock for retaining the dumbbells in the receptacles with the lock shown in its closed position.

The barbell of this invention is generally illustrated as 2 in the drawings. Barbell 2 includes an elongated bar 4 which is elongated along an axis 1. See FIG. 10. Bar 4 may vary in length but is preferably long enough to allow a user to grip bar 4 with the user's hands being spaced apart by approximately the width of the user's shoulders, as shown in FIG. 1. Thus, bar 4 is typically on the order of 3 to 6 feet long, though the precise length of bar 4 is not important to this invention. All that is important is that there be a bar 4 of the type commonly found in barbells.

Bar 4 includes a resilient rubber covering 6 over at least the middle portion of bar 4 and preferably over a majority of the length of bar 4. Covering 6 helps the user more securely grip bar 4 while exercising. Covering 6 may be deleted from bar 4 if so desired.

FIG. 1 depicts the user using barbell 2 prior to beginning a biceps curl exercise. Barbell 2 of this invention may be used to perform all of the weight training exercises commonly associated with barbells. These exercises may be done with the user either standing upright or lying on an exercise bench. For example, when the user lies on an exercise bench and faces upwardly, the user can repetitively lift barbell 2 up and down in a chest press exercise. A wide variety of weight training exercises can be done with barbell 2.

Barbell 2 of this invention comprises a cradle or receptacle 8 carried at either end of bar 4. Receptacles 8 are identical to one another so that a description of one receptacle 8 suffices to describe the other receptacle 8.

Receptacle 8 at either end of bar 4 is generally U-shaped having spaced apart vertical end walls 10 connected together by a horizontal bottom wall 12. Bottom wall 12 can have a plurality of downwardly depending feet 13, which may be of rubber or some other resilient material, for allowing receptacle 8 to rest on a floor or other flat surface without marring the floor. Receptacle 8 has an open upper end 14. Receptacle 8 faces upwardly and is configured to hold a variable exercise mass, as will be described in more detail hereafter. Receptacle 8 has a predetermined length defined by the distance between the inside surfaces of end walls 10.

One end wall 10 includes an outwardly protruding, horizontal mounting sleeve 16 that is telescopically received around one end of bar 4. In one embodiment of barbell 2 of this invention, sleeve 16 is bolted to bar 4 by a bolt 18 which passes through aligned holes provided in both sleeve 16 and the end of bar 4 to securely and non-rotatably fix receptacle 8 to the end of bar 4.

Receptacle 8 is rectangular in shape being longer along a major axis x and shorter along a minor axis y, the major and minor axes x,y being perpendicular to one another. Major axis x of receptacle 8 is parallel to the axis 1 of bar 4 while minor axis y of receptacle 8 is perpendicular to the axis 1 of bar 4. See FIG. 10. When an exercise mass is placed in receptacle 8 between end walls 10, the exercise mass is confined by end walls 10 of receptacle 8 with respect to movement of the exercise mass along major axis x. In other words, end walls 10 of receptacle 8 prevent the exercise mass from sliding out of receptacle 8 along the length of receptacle 8. While it is preferred that end walls 10 be of approximately the same size and shape, end walls 10 could have different sizes and shapes relative to one another as long as they confine the exercise mass and restrain movement of the exercise mass along major axis x.

Receptacle 8 also includes a pair of side rails 20 extending between end walls 10 of receptacle 8 with one side rail 20 being on a front side of receptacle 8 and the other side rail 20 being on the rear side of receptacle 8. Side rails 20 are preferably affixed to or spaced slightly above bottom wall 12 to allow the user to more easily deposit the exercise mass within receptacle 8. However, side rails 20 could be higher up on end walls 10, or multiple side rails 20 could be used on each of the front and rear sides of receptacle 8. The purpose of side 20 rails is to restrain movement of the exercise mass along minor axis y of receptacle 8. In other words, side rails 20 prevent the exercise mass from falling out of receptacle 8 through either the front or rear sides thereof.

Figure 2:
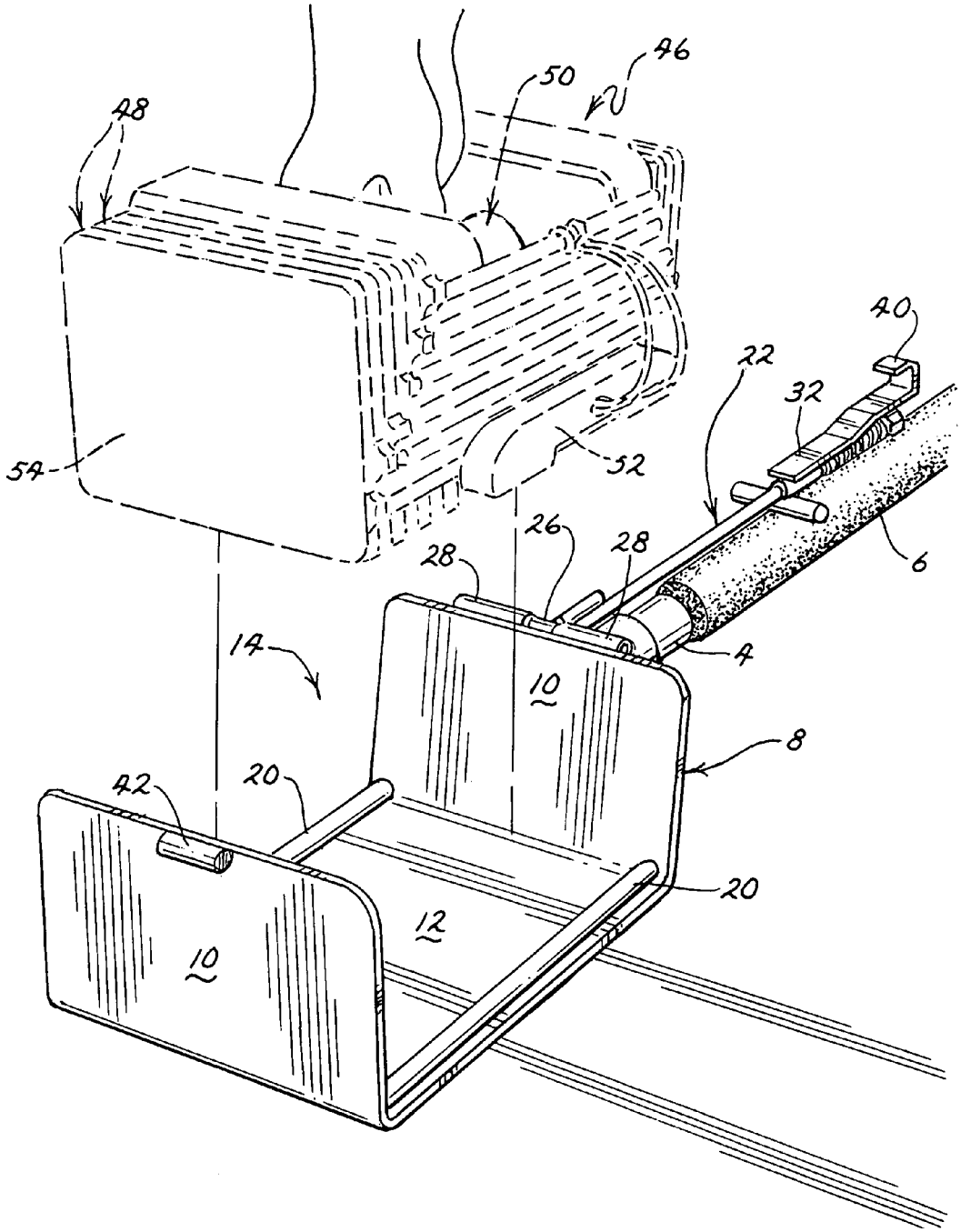
FIG. 2 is a perspective view of one end of the barbell of FIG. 1, particularly illustrating the lock on the receptacle in its open position to allow a selectorized dumbbell to be lowered into or lifted out of the receptacle.

Receptacle 8 includes a pivotal lock 22 on the top thereof. In one embodiment of barbell 2 of this invention, lock 22 includes an elongated locking rod 24 that is parallel to major axis x of receptacle 8. One end 26 of locking rod 24 is T-shaped and is pivotally received in spaced pivot hubs 28 at the top of inner end wall 10 of receptacle 8. Pivot hubs 28 pivotably journal locking rod 24 to receptacle 8 such that locking rod 24 can pivot between an open position in which open upper end 14 of receptacle 8 is unobstructed, as shown in FIG. 2, to a closed position in which locking rod 24 extends across the top of open upper end 14 of receptacle 8, as shown in FIGS. 1, 4 and 5.

Figure 5:
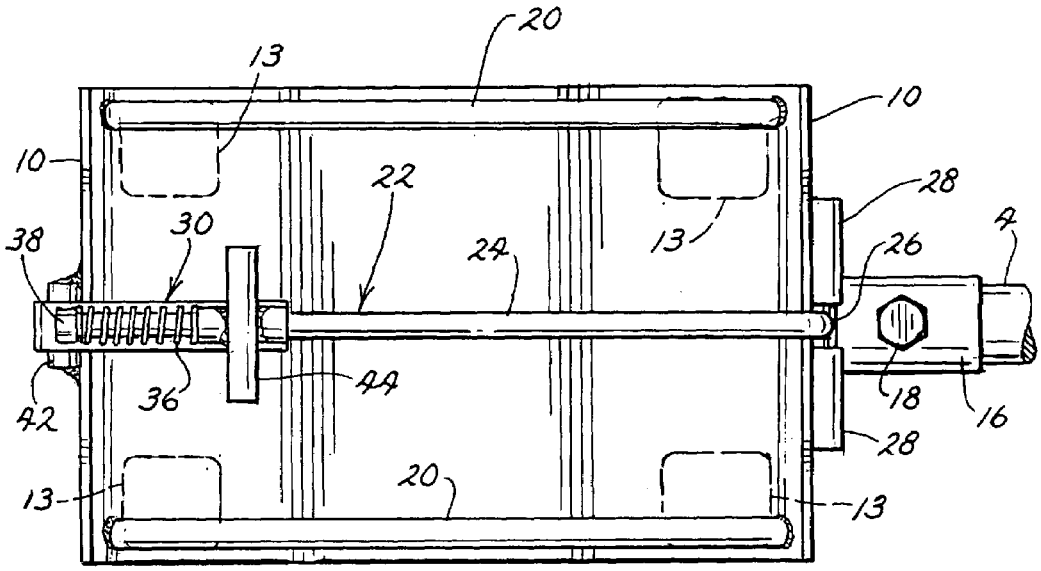
FIG. 5 is top plan view of one end of the barbell of FIG. 1, particularly illustrating an empty receptacle with the lock in its closed position.
Figure 4:
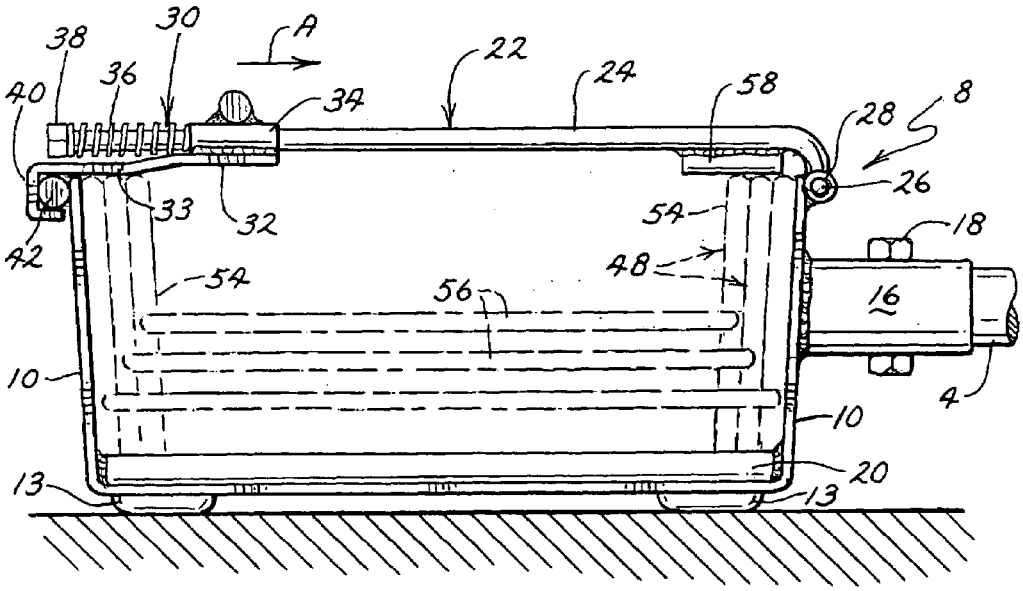
FIG. 4 is a side elevational view of one end of the barbell of FIG. 1, particularly illustrating the receptacle carrying only some of the weights of the selectorized dumbbell as in FIG. 3 and particularly illustrating the lock in its closed position with portions of the lock bearing against the tops of the weights.

In addition, the other end of locking rod 24 includes a spring biased latch shown generally as 30 in FIGS. 1, 4 and 5. Latch 30 includes a latch finger 32 carried on a latch sleeve 34 telescopically received on locking rod 24. A spring 36 is carried around locking rod 24 and bears against a nut or other abutment 38 on the end of locking rod 24 to bias latch sleeve 34 in the direction of the arrow A in FIG. 4. The outer free end of latch finger 32 includes a U-shaped latch hook 40. The bias of spring 36 is sufficient to move latch hook 40 into engagement with a protrusion or tab 42 at the top of outer end wall 10 of receptacle 8. See FIG. 4. The engagement of latch hook 40 with tab 42 locks locking rod 24 in place relative to receptacle 8 to prevent the exercise mass placed in receptacle 8 from falling out through open upper end 14 of receptacle 8.

Figure 3:
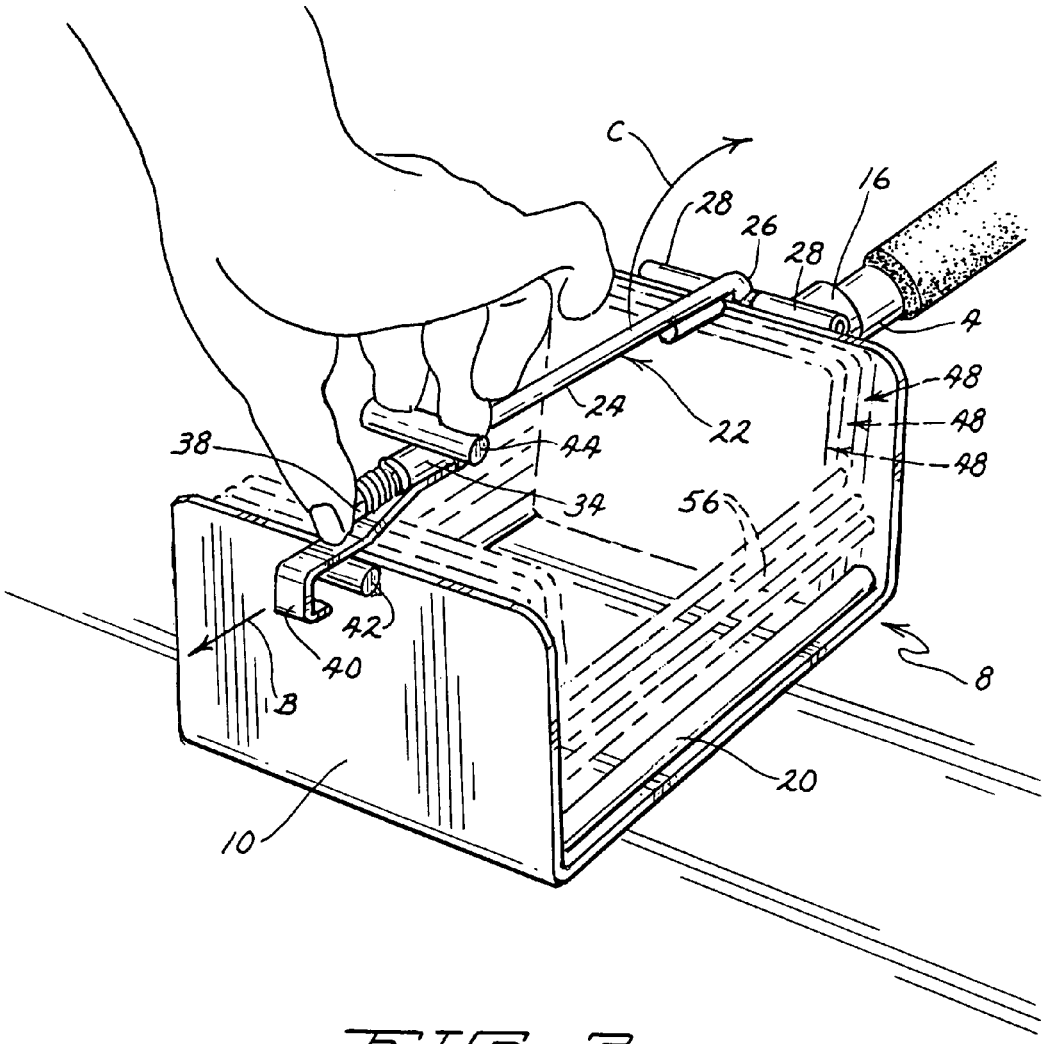
FIG. 3 is a perspective view of one end of the barbell of FIG. 1, particularly illustrating the receptacle carrying only some of the weights of the selectorized dumbbell which weights were left behind by the user after lifting out the remaining portions of the selectorized dumbbell, and further particularly illustrating the user in the act of unlatching the lock on the receptacle to permit the lock to be swung between its closed and open positions.

The disengagement of lock 22 is shown in FIG. 3. If the user desires to disengage lock 22 to allow locking rod 24 to be pivoted to free or clear the open upper end 14 of receptacle 8, the user simply grips the outer end of locking rod 24 with one hand. The user places the user's thumb on abutment 38 and the user's fingers behind a handle or grip 44 provided on the top of latch sleeve 34. The user then squeezes latch 30 against the bias of spring 36 by sliding latch sleeve 34 in the direction of the arrow B in FIG. 3. Latch sleeve 34 can slide far enough so that latch hook 40 disengages from tab 42, also as shown in FIG. 3. With latch 30 in this disengaged position, the user can rotate locking rod 24 in the direction of the arrow C in FIG. 3 until locking rod 24 has been flipped over, i.e. pivoted 180°, and locking rod 24 now lies inboard of receptacle 8 overlying bar 4. See FIG. 2 for the open position of lock 22. In this position, as noted earlier, locking rod 24 has been removed completely from any interfering or obstructing relationship to open upper end 14 of receptacle 8.

Receptacle 8 at each end of barbell 2 is particularly designed for holding an adjustable weight dumbbell 46, or portions of such a dumbbell 46, to form the adjustable weight exercise mass. More particularly, receptacle 8 is designed for use with a dumbbell 46 known as the Power Block which is manufactured and sold by Intellbell, Inc. of Owatonna, Minn. The Power Block dumbbell is also disclosed more fully in U.S. Pat. No. 5,637,064, which is hereby incorporated by reference.

Referring to FIG. 2, dumbbell 46 is shown in phantom and is a "selectorized dumbbell". The term "selectorized dumbbell" as used herein shall mean a dumbbell 46 having a plurality of weights 48 which can be coupled to a central handle 50 by a selector 52. Each weight 48 comprises two spaced apart weight plates 54 rigidly connected to one another by side rails 56 extending between a pair of weight plates 54. Weight plates 54 on adjacent weights 48 are spaced apart at progressively greater distances from one another, and side rails 56 on adjacent weights are at progressively lower elevations, so that weights 48 can be nested together. When so nested, weight plates 54 on one end of weights 48 are stacked adjacent one another in a first stack and weight plates 54 on the other end of weights 48 are stacked adjacent one another in a second stack.

The number of weights 48 coupled to handle 50 of dumbbell 46 can be varied by the position of selector 52. In other words, by moving selector 52 to different positions, different numbers of weights 48 can be coupled to dumbbell 46 for lifting with dumbbell 46. As shown in FIG. 2, six weights 48 are coupled to handle 50 with selector 52 being placed beneath the lowermost side rails 56 of the sixth weight 48. If selector 52 were moved and placed beneath the side rails 56 of one of the upper weights 48, then fewer weights 48 would be coupled to handle 50 of dumbbell 46, in the manner that is well known for the Power Block product and as disclosed in U.S. Pat. No. 5,637,064.

Dumbbell 46 disclosed herein can be used to form the exercise mass in two different ways. The first way is to lift a dumbbell of the type shown in FIG. 2 into receptacle 8 with dumbbell 46 being configured in a first loaded condition having a plurality of weights 48 coupled to handle 50. This is done by opening receptacle 8 by unlocking lock 22 and by dropping dumbbell 46 with all six weights 48 attached thereto down between end walls 10 of receptacle 8 and between receptacle side rails 20. When dumbbell 46 is so received, dumbbell 46 will rest on bottom wall 12 of receptacle 8 and will be retained within receptacle 8 by end walls 10 and side rails 20. The user can then simply close lock 22 over the top of receptacle 8. When lock 22 is latched in place using latch 30, the entire dumbbell 46 forms the exercise mass, as shown in FIG. 1.

However, in many cases, using a dumbbell 46 loaded with many weights 48 might make barbell 2 too heavy for many users. Instead, the user can easily adjust the exercise mass prior to closing lock 22 in the following manner. After dumbbell 46 in its first loaded condition is placed into receptacle 8, the user can adjust dumbbell 46 into a second loaded condition in which fewer weights 48 are coupled to handle 50. This is done by moving selector 52 up from its position beneath the side rails 56 of the sixth weight 48 to a position beneath the side rails 56 of one of the upper weights 48, for example beneath the side rails 56 of the third weight 48. The user can then lift or pull up on handle 50 of dumbbell 46 to remove handle 50 and the upper three weights 48 that are attached to handle 50, thereby leaving the lower three weights 48 within receptacle 8, as shown in FIGS. 3 and 4. Lock 22 can now be closed over the open upper end 14 of receptacle 8 with the bottom three weights 48 now forming the exercise mass.

Obviously, any number of weights 48 can be left in receptacle 8 simply by choosing a position for selector 52 so that the appropriate number of weights is removed when dumbbell 46 is lifted back out of receptacle 8. If a loaded dumbbell normally has six 10 pound weights 48 thereon, and one wishes to leave only twenty pounds in receptacle 8 comprising two weights 48, then selector 52 is moved until it is beneath the side rails 56 of the fourth weight 48. Then, when handle 50 is lifted up and out of receptacle 8, the upper four weights 48 will come with handle 50, while the lower two weights 48 will not. Similarly, if one wished to leave four weights 48, then selector 52 would be positioned beneath the side rails 56 of the second weight 48, and so on.

In this mode of operation, dumbbell 46 in its first loaded condition is used simply as a vehicle for depositing a number of weights 48 into receptacle 8. The user first lifts dumbbell 46 in its first loaded condition into receptacle 8, adjusts selector 52 to leave behind a desired number of weights 48 in receptacle 8, and then lifts handle 50 and the other undesired weights 48 back out of receptacle 8. Since the lowermost weight 48 is the longest weight 48 with all the other weights 48 being progressively shorter, the weights 48 that are left behind will extend over the length of receptacle 8 to fit in a nested fashion with the stacked weight plates 54 on either side of nested weights 48 lying adjacent end walls 10 of receptacle 8. Thus, the weights 48 that are left behind or deposited in receptacle 8 will not slide along the major axis x of receptacle 8. In this regard, the spacing between end walls 10 is preferably selected so that the length of receptacle 8 is slightly longer than the length of lowermost weight 48.

Another distinct advantage of using dumbbell 46 to deposit or leave behind a desired number of weights 48 in receptacle 8 is that dumbbell 46 can continue to be used as a dumbbell with the remaining weights 48 after dumbbell 46 and the remaining weights 48 are lifted back out of receptacle 8. Thus, effectively, dumbbell 46 can do double duty. Some of weights 48 of dumbbell 46 can be deposited in receptacle 8, with weights 48 of a second dumbbell being similarly deposited in the other receptacle 8 at the opposite end of bar 4, and then each dumbbell is still free to be used by other people. Thus, one person can exercise using barbell 2 loaded with some dumbbell weights 48 while dumbbell 46 itself with the remaining weights 48 can be used by another person. This provides great flexibility and economy in a group exercise setting or in a setting where the weight training equipment is shared by many people, such as in a gym.

The first loaded condition of dumbbell 46 would typically refer to a dumbbell 46 having all the weights 48 attached to handle 50 that are sold with dumbbell 46 and that are capable of being attached to handle 50, namely the six weights shown in FIG. 2 with selector 52 beneath the lowermost weight. As noted earlier, the distance between end walls 10 of receptacle 8 is selected to be slightly longer than the length of dumbbell 46 in its first loaded condition, i.e. slightly longer than the length of the lowermost weight 48. However, the first loaded condition of dumbbell 46 is not restricted to this situation, but would apply to dumbbells in which receptacle 8 is long enough to encompass at least some of the weights 48 that could be attached to handle 50, but not necessarily all of the weights 48. For example, the first loaded condition of dumbbell 46 would also refer to a dumbbell 46 with four weights 48 attached to handle 50, and with end walls 10 of receptacle 8 being spaced apart slightly greater than the length of the fourth weight 48, without using the other two weights 48 that came with dumbbell 46. This is not preferred since it decreases the amount of adjustability for the exercise mass. However, a dumbbell which has fewer than the maximum number of weights 48 when in its first loaded condition would be slightly lighter and thus easier to lift into receptacle 8 to begin the weight depositing operation described above.

As shown in the drawings, when locking rod 24 is pivoted into its closed position extending across open upper end 14 of receptacle 8, the underside of locking rod 24 will engage, at least at spots, the tops of weights 48 that are left behind in receptacle 8 to help hold weights 48 in place. This is accomplished by forming latch finger 32 with a downwardly offset portion 33 that will rest or abut against the tops of weights 48 when locking rod 24 is closed. The other end of locking rod 24 has a downwardly extending spacer or bumper 58 for contacting and abutting against the tops of weights 48. The purpose of offset 33 in latch finger 32 and downwardly extending bumper 58 is simply to help further restrain vertical movement of weights 48 in receptacle 8.

Another way of using dumbbell 46 as the exercise mass is to let dumbbell 46 with a number of weights attached to handle 50 remain in receptacle 8 such that the entire dumbbell with the attached weights forms the exercise mass. In this method, the user would first select the desired number of weights for use prior to lifting dumbbell 46 into receptacle 8. For example, if one wanted to use the weight equal to handle 50 and the first three weights, then the user would insert selector 52 beneath the third weight and then lift up on handle 50. Handle 50 and the first three weights 48 would rise while the lower three weights would remain on the floor or in a rack designed to hold dumbbell 46. The user would them simply deposit the entire dumbbell 46 with the three selected weights 48 into receptacle 8 such that the entire dumbbell now forms the exercise mass.

Because the entire dumbbell 46 would now have different lengths depending upon the number of weights 48 attached to handle 50, dumbbell 46 when deposited in receptacle 8 would potentially be shorter than the length of receptacle 8. For example, if end walls 10 were set apart by a distance designed to accommodate handle 50 with all six weights 48 as shown in FIG. 1, a dumbbell 46 with only three weights 48 would be shorter and would not take up all the space between end walls 10. In this event, it would be preferable to have some means for preventing dumbbell 46 from sliding in receptacle 8 along major axis x. One way to prevent this would be to form various upwardly extending detents (not shown) on bottom wall 12 of receptacle 8, which detents in combination with the retention provided by offset 33 in latch finger 32 and bumper 58 on locking rod 24 would be enough to prevent sliding.

In one embodiment of a barbell of this invention, major axis x of receptacle 8 is parallel to the axis 1 of bar 4. This positions handle 50 of dumbbell 46 parallel to or in line with the axis 1 of bar 4. This is a preferred orientation for receptacle 8 since weights 48 are not offset forwardly or rearwardly of bar 4. Thus, weights 48 do not serve to torque bar 4 as the user lifts bar 4 up and down as would happen if weights 48 were offset forwardly or rearwardly of bar 4. FIG. 10 shows this in line receptacle orientation as do FIGS. 1–9.

Figure 11:
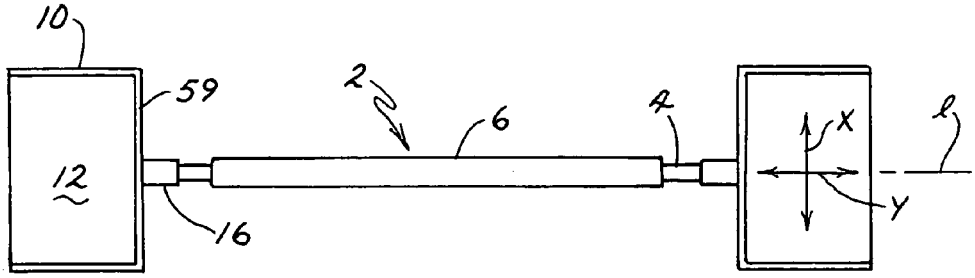
FIG. 11 is a diagrammatic top plan view of a third embodiment of a barbell according to this invention, particularly illustrating a perpendicular orientation of the receptacles relative to the bar.

However, FIG. 11 shows a perpendicular orientation of receptacle 8 in which the minor axis y of receptacle 8 is parallel to or in line with bar 4 while the major axis x of receptacle 8 is perpendicular to bar 4. Each receptacle 8 would have a side wall 59 carrying mounting sleeve 16 in place of side rail 20 on that side. While this orientation places weights 48 on both sides of the axis, nonetheless a bar 4 having receptacles 8 in this orientation is also an embodiment of this invention. All of the other advantages discussed previously in which receptacles 8 can accept selected weights 48 from a selectorized dumbbell 46 or an entire dumbbell 46 carrying a desired number of weights 48 pertain to this receptacle orientation as fully as the in line receptacle orientation.

Figure 6:
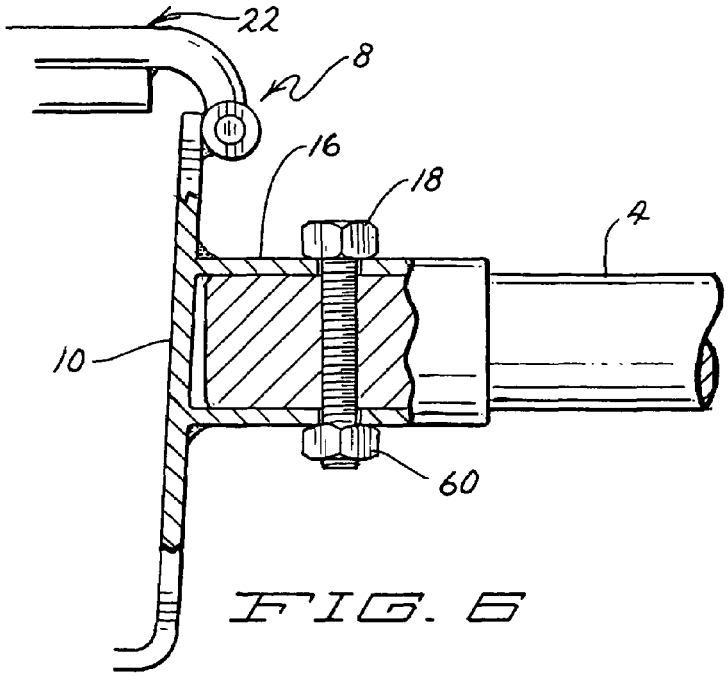
FIG. 6 is a partial cross-sectional view of one end of the barbell of FIG. 1, particularly illustrating the fixed attachment of the receptacle to the end of the bar.

In the embodiments of barbell 2 as described thus far, receptacle 8 is fixed to the end of bar 4 in a secure and non-rotatable manner. As shown in FIG. 6, a bolt 18 passes down through mounting sleeve 16 on each receptacle 8 and through the end of bar 4. A nut 60 is used to tighten bolt 18 in place with the result that receptacle 8 moves up and down with bar 4 but does not rotate relative to bar 4. Mounting sleeve 16 is located approximately at the center of receptacle 8. In this embodiment, it is preferred that receptacle 8 include lock 22 described above to help keep weights 48 or dumbbell 46 in place in receptacle 8.

Figure 7:
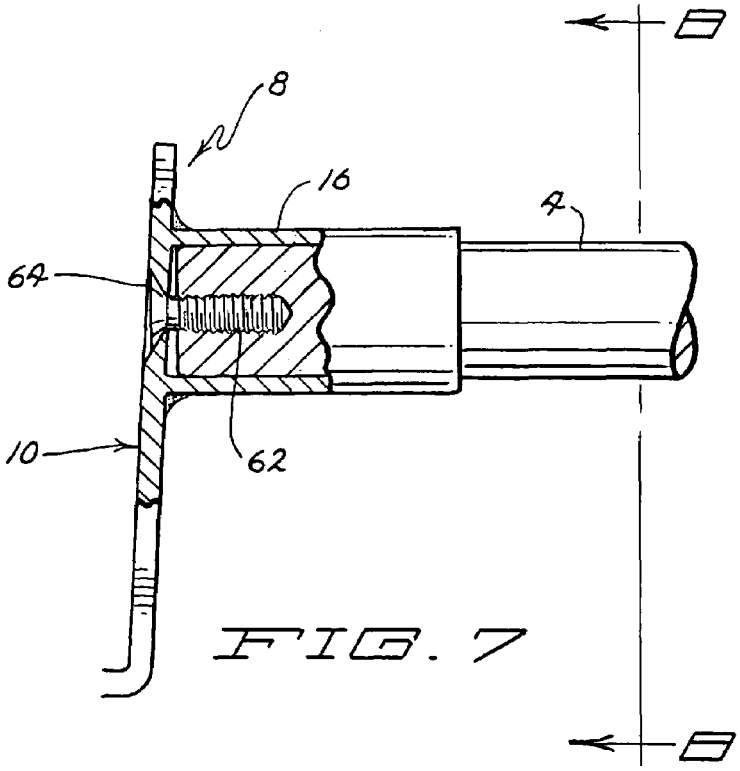
FIG. 7 is a partial cross-sectional view of a portion of one end of a second embodiment of a barbell according to this invention, particularly illustrating a rotatable attachment of the receptacle to the end of the bar to allow the receptacle to remain upright during lifting and lowering of the barbell and with there being no lock at the top of the receptacle.
Figure 8:
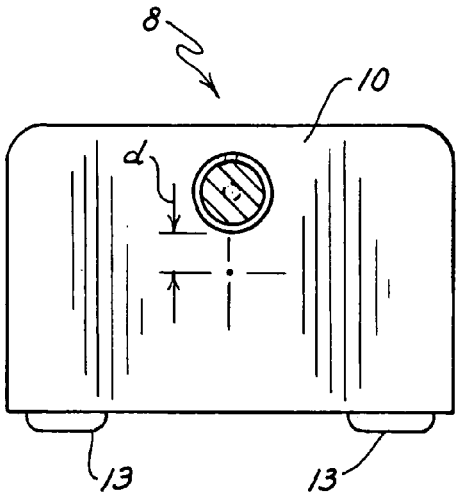
FIG. 8 is a cross-sectional view of the barbell of FIG. 7, taken along lines 8—8 in FIG. 7.
Figure 9:
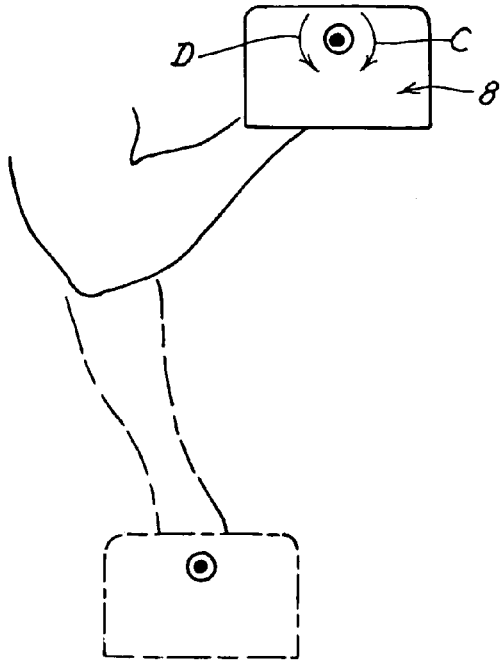
FIG. 9 is a diagrammatic view of the operation of the barbell of FIG. 7, particularly illustrating how the receptacle remains upright during lifting and lowering of the barbell.
Figure 10:
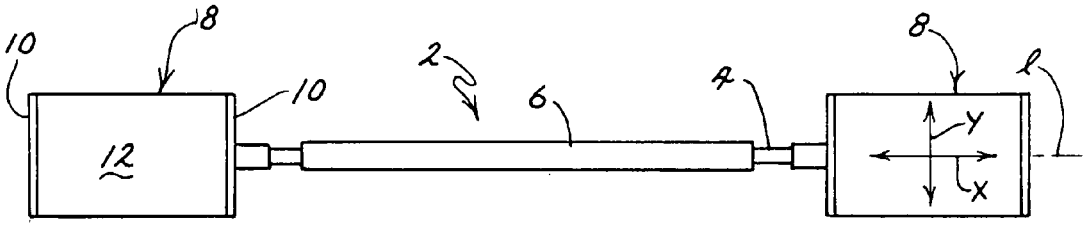
FIG. 10 is a diagrammatic top plan view of the barbell of FIG. 1, particularly illustrating the in line orientation of the receptacles relative to the bar.

FIGS. 7–9 describe an alternative embodiment of receptacle 8 in which the mounting sleeve 16 of receptacle 8 pivots around the end of bar 4. A machine bolt 62 passes through a hole 64 in end wall 10 of receptacle 8 and into the end of bar 4. Bolt 62 does not clamp receptacle 8 to the end of bar 4, but simply serves to retain receptacle 8 on the end of bar 4 such that receptacle 8 does not fall off the end of bar 4. In fact, receptacle 8 is free to pivot around bar 4 with mounting sleeve 16 pivoting around the end of bar 4 as shown by the clockwise and counter-clockwise arrows C and D in FIG. 9. Mounting sleeve 16 is moved above the center of receptacle 8 by an offset d as shown in FIG. 8.

The purpose of rotatably mounting receptacle 8 on the end of bar 4 with the pivot being offset relative to the center of receptacle 8, and thus offset to the center of mass of receptacle 8, is to allow receptacle 8 to self-pivot around bar 4 and remain upright as bar 4 moves up and down in an exercise. For example, in the biceps curl exercise shown in FIG. 9, receptacle 8 will pivot around bar 4 as the user swings bar 4 forwardly and upwardly, remaining upright through the range of motion shown in FIG. 9. Because receptacle 8 will remain upright, it would be possible to delete lock 22 from the top of receptacle 8 since weights 48 will not fall out of receptacle 8 in normal exercises. It is intended that the alternative embodiment shown in FIGS. 7–9 thus not have a lock 22 of the type shown in FIGS. 1–6, though such a lock 22 could still be used for additional safety if so desired.

Figure 12:
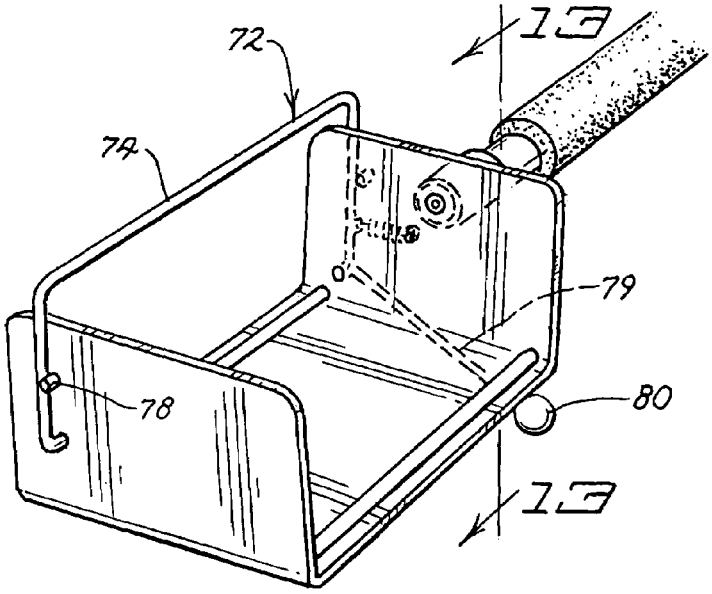
FIG. 12 is a perspective view of one end of a fourth embodiment of a barbell according to this invention, particularly illustrating another form of lock for the receptacle with the lock being automatically engaged and disengaged by lifting the barbell off the floor or by lowering the barbell into contact with the floor, respectively.
Figure 13:
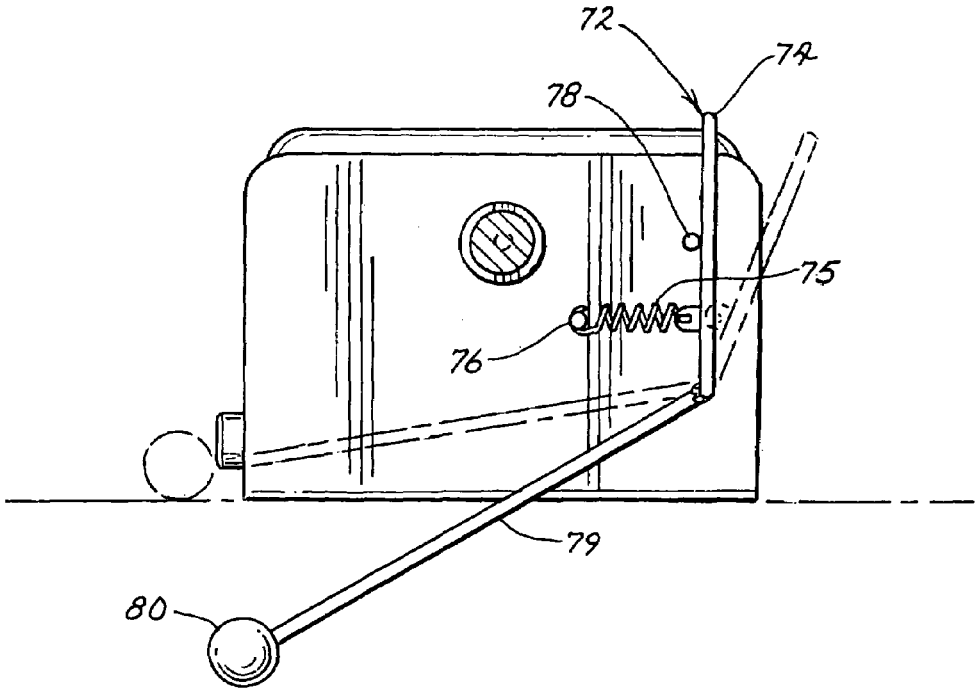
FIG. 13 is a side elevational view of the barbell of FIG. 12, particularly illustrating the lock in its closed position in solid lines and the lock in its open position in phantom lines.
Figure 14:
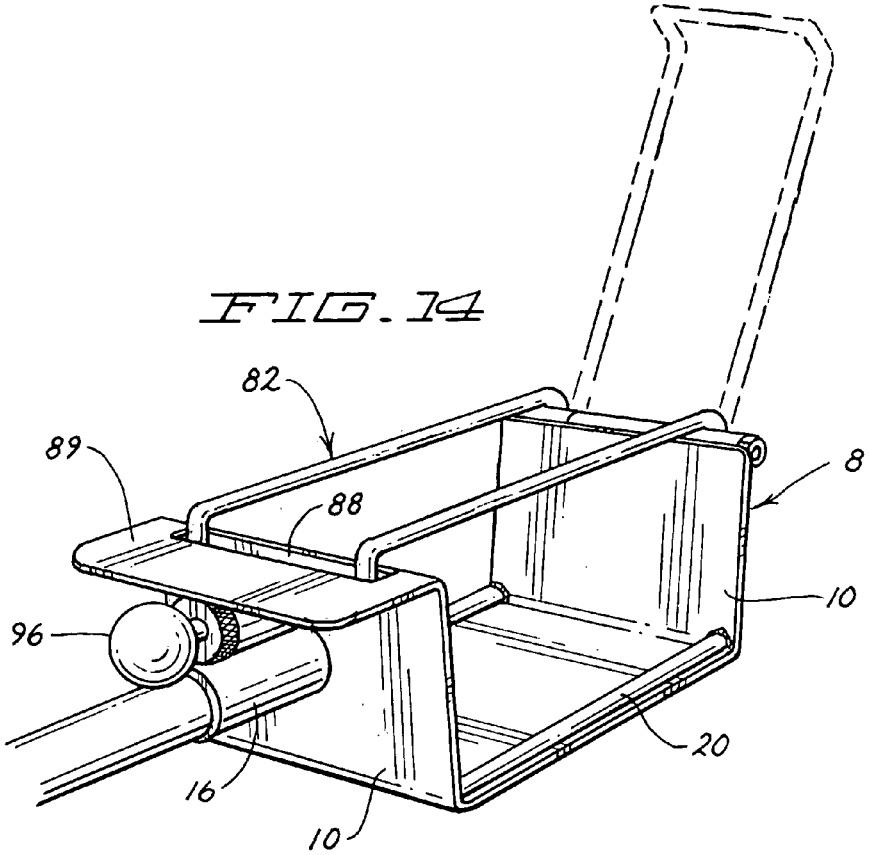
FIG. 14 is a perspective view of one end of a fifth embodiment of a barbell according to this invention, particularly illustrating yet another form of lock for the receptacle with the lock being shown in its closed position in solid lines in FIG. 14.
Figure 15:
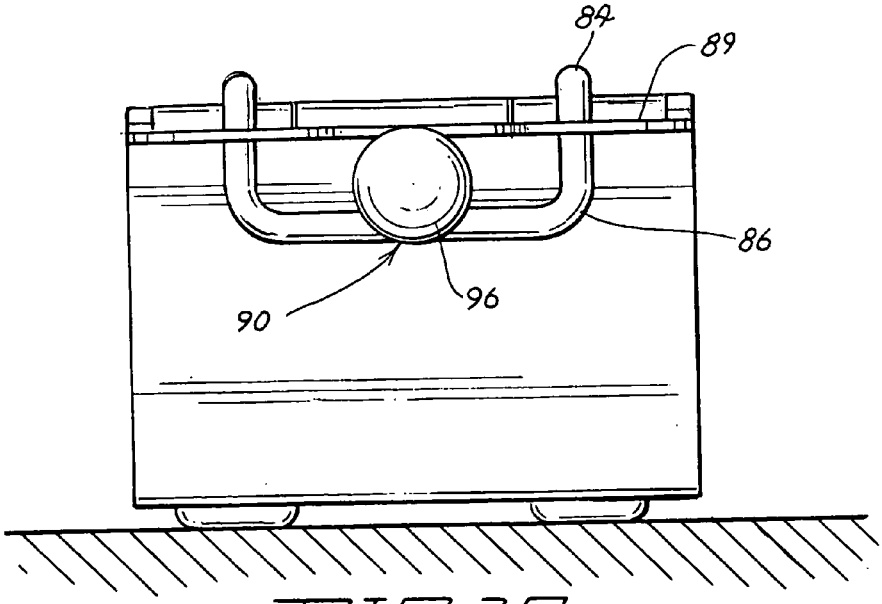
FIG. 15 is an end elevational view of the inner end wall of the receptacle of the barbell of FIG. 14.

FIGS. 12 and 13 shown an alternative embodiment of a lock 72 which could be used with receptacle 8, in place of lock 22 shown in FIGS. 1–6. Lock 72 shown in FIG. 13 is designed to automatically disengage when the user places barbell 2 on the floor and to automatically engage when the user picks up barbell 2 from the floor. In this regard, lock 72 comprises a U-shaped member 74 that is pivotally joined to end walls 10 of receptacle 8. Member 74 is biased by a spring 75 extending between one of the arms of member 74 and a pin 76 on one end wall 10 until member 74 is biased into a closed position defined when the arms of member 74 engage stops 78 on end walls 10. In the closed position, member 74 overlies receptacle 8 to perform the same weight retaining function as the pivotal lock 22 shown in FIG. 1. The closed position of member 74 is shown in solid lines in FIGS. 12 and 13.

Member 74 is also formed with an arm 79 that is designed to engage against the floor, the end of arm 79 having a ball 80 which contacts the floor. When receptacle 8 rests on the floor, ball 80 has contacted the floor and rotated arm 79, and thus member 74, in a first direction until member 74 is disposed in an open condition in which member 74 has cleared the top of receptacle 8. This open condition is shown in FIG. 13 in phantom lines. In this condition, spring 75 has become further tensioned, but spring 75 cannot move member 74 to the closed position because of the engagement of the floor with arm 79.

However, when the user picks barbell 2 up and receptacle 8 clears the floor, arm 79 and ball 80 on the end of arm 79 will be lifted up off the floor. The tension in spring 75 is then effective to rotate member 74 in an opposite direction from its open to its closed positions. This is done automatically simply by lifting barbell 2 off the floor. As soon as barbell 2 is lifted high enough to allow spring 75 to move member 74 all the way to the locked position, which simply means lifting barbell 2 a few inches, lock 72 will engage automatically without the user having to manually engage lock 72

Similarly, at the completion of the exercise routine with barbell 2, the-user will at some point lower barbell 2 back down into engagement with the floor. As barbell 2 approaches the floor, ball 80 on the end of arm 79 hits the floor. As the lowering of barbell 2 continues, the engagement between ball 80 and the floor will pivot arm 79 to pivot member 74 from its closed position to its open position. When barbell 2 has been fully lowered back down onto the floor, member 74 is moved all the way to its open position automatically, such that open upper end 14 of receptacle 8 is now clear. The user can then access receptacle 8 to remove or adjust the exercise mass without having to first manually disengage lock 72. Thus, the embodiment of FIGS. 12 and 13 relates to an automatically engaging and disengaging lock which responds to lifting barbell 2 off the floor or lowering barbell 2 onto the floor, respectively.

FIGS. 14 to 17 illustrate another embodiment of a manual lock 82 for receptacle 8, which manual lock 82 could also be used in place of lock 22 shown in FIGS. 1–6. Lock 82 includes a U-shaped bail 84 instead of a single locking rod 24, bail 84 being pivotally attached to the top of the outer end wall 10 of receptacle 8. Bail 84 is long enough to extend over the entire length of receptacle 8 with the closed or U-shaped end 86 of bail 84 being free and capable of being positioned slightly past the outer end wall 10 of receptacle 8. In addition, U-shaped end 86 of bail 84 is turned downwardly.

In the operation of bail 84, bail 84 is pivotal about one end that is pivotally attached to the outer end wall 10 of receptacle 8 by spaced pivot hubs 98 pivotally journalled to a central pivot 99. In other words, bail 84 can pivot from a closed-position in which bail 84 overlies receptacle 8 to an open position in which bail 84 has been pivoted out of the way of open upper end 14 of receptacle 8. In the closed position of bail 84, bail 84 will overlie and engage against the top of the exercise mass placed in receptacle 8. In the open position of bail 84, bail 84 will clear receptacle 8 to allow the exercise mass to be placed in or removed from receptacle 8.

When bail 84 is in the closed position thereof, the downturned free end of bail 84 will pass downwardly through a locking slot 88 in a horizontal flange 89 on receptacle 8. The bottom of flange 89 includes a spring biased latch 90 that is biased inwardly towards receptacle 8. Latch 90 comprises a locking pin 92 biased by a spring 94.

Figure 16:
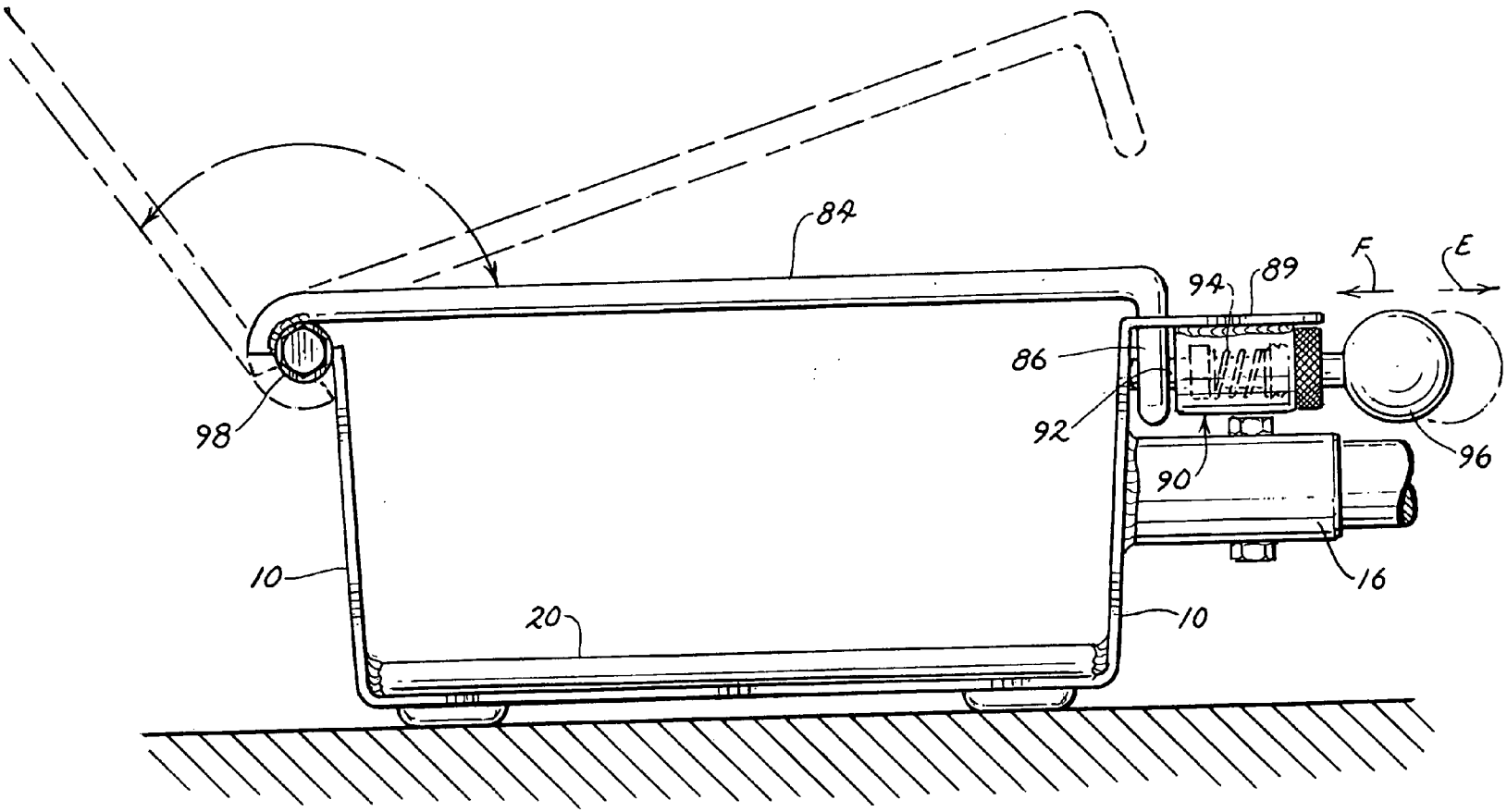
FIG. 16 is a side elevational view of the barbell of FIG. 14, particularly illustrating movement of the lock between its open position and its closed position.
Figure 17:
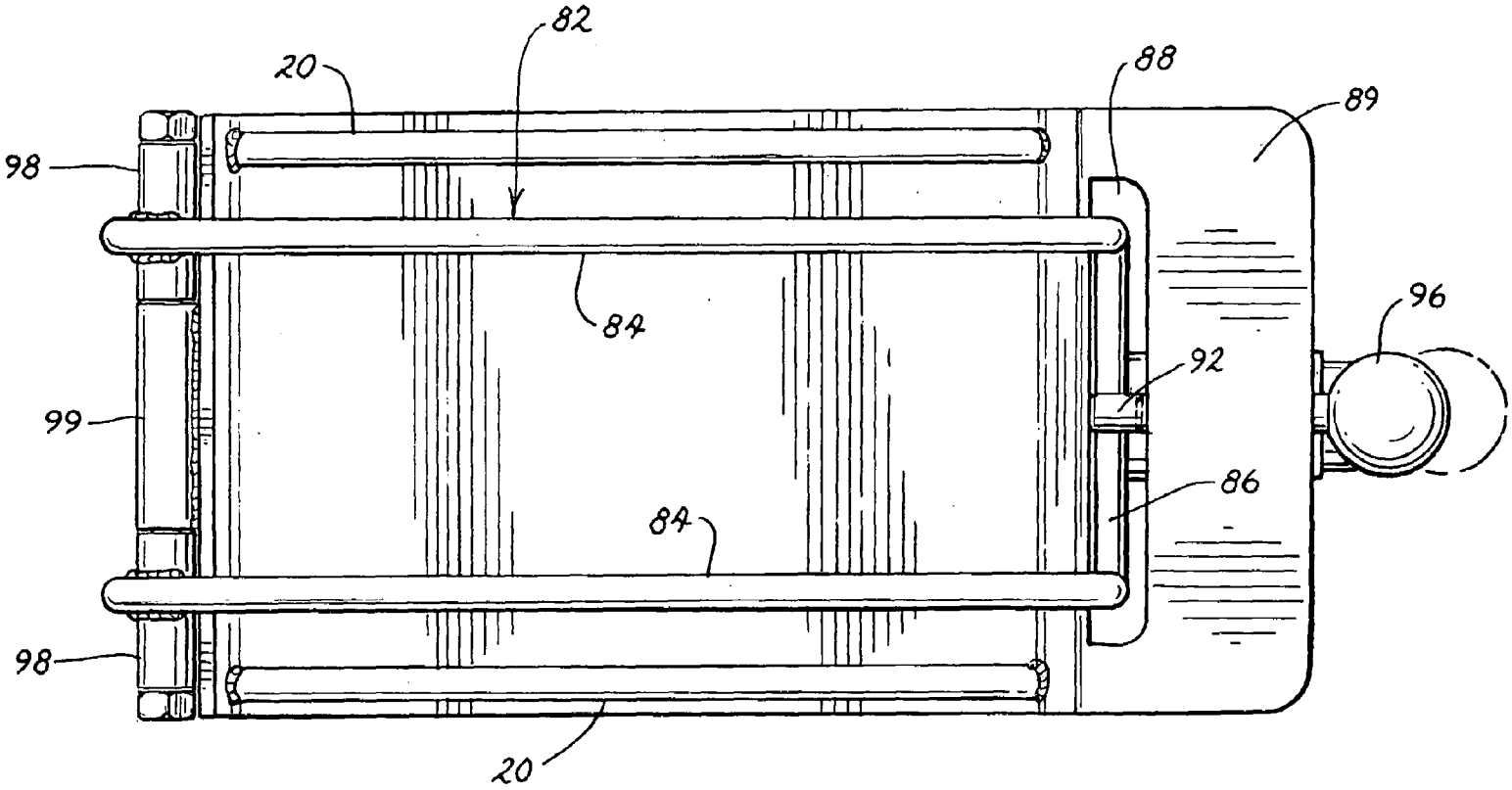
FIG. 17 is a top plan view of one end of the barbell of FIG. 14.

The user can pull laterally in the direction of the arrow E in FIG. 16 to release locking pin 92 by pulling on an enlarged knob 96 provided on the end of locking pin 92. When the user lets go of locking pin 92, the spring bias on locking pin 92 will move locking pin 92 in the opposite direction, namely in the direction of the arrow F in FIG. 16, to cause the end of locking pin 92 to move over the downturned free end 86 of bail 84 after the free end of bail 84 is received in locking slot 88. The engagement of locking pin 92 in this manner locks bail 84 in place relative to receptacle 8. Locking pins. 92 of this type are well known with respect to exercise equipment.

To release bail 84 from its closed position, the user simply pulls on locking pin in the direction of the arrow E until the end of pin 92 clears the downturned free end 86 of bail 84. The user can then pivot bail 84 upwardly as desired to move bail 84 from its closed to its open position. Conversely, to relock bail 84 in its closed position, the user first pivots bail 84 back down until the downturned free end 86 of bail 84 enters locking slot 88 in flange 89. Pin 92 has to be first retracted by pulling on the pin in the direction of the arrow E to permit the free end 86 of bail 84 to be fully received in locking slot 88. In any event, once bail end 86 is fully received in locking slot 88, the user simply releases pin 92 to allow the bias of spring 94 to move pin 92 back over and on top of bail end 86 to lock bail 84 in place relative to receptacle 8.

While either of the manual locks 22 or 82 shown herein can be used, lock 82 comprising the U-shaped bail presents a blunt or closed end when bail 84 is unlocked. Such a blunt end lessens the risk of injury if the user should fall against the free end 86 of bail 84.

Various other modifications of this invention will be apparent to those skilled in the art. For example, U-shaped cradle of receptacle 8 as disclosed herein can be used to accommodate a plurality of stacked weight plates as the exercise mass even if such weight plates do not come from dumbbells. Accordingly, the scope of this invention will be limited only by the appended claims.

We claim:

1. A barbell for weight training adapted to use at least portions of dumbbells as exercise mass, wherein each dumbbell includes a handle having at least one weight plate carried on either end of the handle, which comprises:

(a) a bar elongated along an axis;

(b) a receptacle carried at each end of the bar, wherein the receptacle has a length which is long enough to permit the dumbbell including the handle and the weight plates carried on the handle to be placed into and received within the length of the receptacle, wherein the receptacle includes an open upper end which provides access to the receptacle from above to allow a dumbbell to be lowered into or lifted out of the receptacle;

(c) a locking member pivotally connected to the receptacle for selectively closing or opening the open upper end of the receptacle, wherein the locking member pivots between a closed position in which the locking member overlies the open upper end of the receptacle and an open position in which the locking member clears the open upper end of the receptacle; and (d) a substantially rigid latching member that is movably mounted to either the receptacle or the locking member, wherein the latching member is biased by a spring into a first position in which the latching member latches the locking member to the receptacle after the locking member has been pivoted into its closed position, wherein the latching member is selectively movable against the bias of the spring to a second position in which the locking member is free to pivot from the closed position thereof to the open position thereof.

2. The barbell of claim 1, wherein the receptacle has a longer major axis and a shorter minor axis, and wherein the handle of the dumbbell is parallel to the major axis of the receptacle when the dumbbell is received within the receptacle.

3. The barbell of claim 2, wherein the major axis of the receptacle is parallel to the axis of the bar.

4. The barbell of claim 2, wherein the major axis of the receptacle is perpendicular to the axis of the bar.

5. The barbell of claim 1, wherein the receptacle is fixed relative to the end of the bar.

6. The barbell of claim 1, wherein the receptacle is rotatably carried on the end of the bar such that the receptacle remains upright as the bar is lifted up and down.

7. The barbell of claim 1, wherein the receptacle has spaced apart end walls which define the length of the receptacle and which prevent the dumbbell from longitudinally falling out of the receptacle along the length of the receptacle.

8. The barbell of claim 7, wherein the receptacle includes a side rail along a front side of the receptacle and a side rail along a rear side of the receptacle to prevent the dumbbell from laterally falling out of the receptacle in a direction that is perpendicular to the length of the receptacle.

9. The barbell of claim 8, wherein a single side rail is used on the front side of the receptacle and a single side rail is used on the rear side of the receptacle.

10. The barbell of claim 9, wherein the side rails are placed slightly above a bottom wall of the receptacle which bottom wall joins the end walls of the receptacle.

11. The barbell of claim 10, wherein the side rails extend between and are joined to the end walls of the receptacle.

12. The barbell of claim 1, wherein the locking member comprises a single elongated locking rod, and wherein the latching member is carried on one end of the elongated locking rod which latching member engages with a tab on the receptacle to hold the locking rod in place.

13. The barbell of claim 1, wherein the locking member comprises a locking bail having a U-shaped free end.

14. The barbell of claim 13, wherein the latching member is a spring biased pin carried on the receptacle which pin locks over the tree end of the bail in the closed position of the bail.

15. The barbell of claim 14, wherein the free end of the bail is downturned to slide through a slot on the receptacle in the closed position, and wherein the spring biased pin fits over the downturned free end of the bail after the free end of the bail is received through the slot to prevent the bail from being removed from the slot to thereby retain the bail in the closed position.

16. The barbell of claim 1, further including a floor engaging member that moves the locking member automatically between the closed and open positions whenever the bar engages the floor.

17. The barbell of claim 1, wherein the dumbbell carries a plurality of weight plates on either end of the handle.

18. The barbell of claim 1, wherein an entire dumbbell including the weight plates carried on the handle may be left in the receptacle such that the entire dumbbell forms an exercise mass for the end of the bar on which the receptacle is carried.

19. The barbell of claim 1, wherein the dumbbell is a selectorized dumbbell having a plurality of weight plates on either end of the handle, the selectorized dumbbell having a selector for allowing a user to select a desired number of weight plates to be coupled to either end of the handle to allow the user to vary the weight carried by the handle, and wherein the user may position the selector following placement of the dumbbell in the receptacle to leave behind in the receptacle a desired number of weight plates after removal of the selectorized dumbbell from the receptacle such that the weight plates left behind in the receptacle form an exercise mass for the end of the bar on which the receptacle is carried.

20. The barbell of claim 19, wherein the selectorized dumbbell is of a type in which a pair of weight plates comprising one weight plate on one end of the handle and a corresponding weight plate on the other end of the handle are joined together by at least one connecting member to form a single individual weight.

21. A barbell for weight training, which comprises:

(a) a bar;

(b) wherein each end of the bar is configured to detachably receive at least portions of a selectorized dumbbell as exercise mass on each end of the bar, wherein each end of the bar includes a recentacle having spaced apart end walls loined by a bottom wall; and (c) at least one selectorized dumbbell for providing exercise mass for each end of the bar, wherein the selectorized dumbbell includes a set of weights forming two spaced apart stacks of weight plates, the weight plates in each stack being nested against one another with a gap or space being provided between the stacks of weight plates to allow at least a portion of a handle of the selectorized dumbbell to be dropped down between the spaced apart stacks of weight plates to couple a desired number of weight plates to each end of the handle as determined by the position of a selector; and (d) wherein each end of the bar is further configured to retain at least a plurality of the nested weight plates from each of the spaced apart stacks of weight plates of the selectorized dumbbell with the weight plates being maintained in the spaced apart stacks when retained on each end of the bar, and wherein the weight plates retained on each end of the bar rest on the bottom wall of the receptacle on each end of the bar.

22. The barbell of claim 21, wherein the weight plates in the spaced apart nested stacks are joined together in pairs with one weight plate in one stack being connected by at least one connecting member to a corresponding weight plate in the other stack.

23. The barbell of claim 21, wherein the bar is elongated along an axis, and wherein the nested weight plates on each end of the bar are located in line with the axis of the bar when the nested weight plates are retained on each end of the bar.

24. A barbell for weight training adapted to use at least portions of dumbbells as exercise mass, wherein each dumbbell includes a handle having at least one weight plate carried on either end of the handle, which comprises:

(a) a bar elongated along an axis;

(b) a receptacle carried at each end of the bar, wherein the receptacle has a length which is long enough to permit the dumbbell including the handle and the weight plates carried on the handle to be placed into and received within the length of the receptacle;

(c) wherein the receptacle has spaced apart end walls which define the length of the receptacle and which prevent the dumbbell from longitudinally falling out of the receptacle along the length of the receptacle, wherein the receptacle includes a side member along a front side of the receptacle and a side member along a rear side of the receptacle to prevent the dumbbell from laterally falling out of the receptacle in a direction that is perpendicular to the length of the receptacles and wherein the side members are partial height and are substantially lower in height than the end walls to allow the dumbbell to be more easily inserted into or removed from the receptacle.

25. The barbell of claim 24, wherein each side member comprises an elongated rail that extends between and joins the end walls of the receptacle adjacent a bottom wall of the receptacle.

26. A method for providing exercise mass on each end of a barbell, which Comprises:

(a) providing selectorized dumbbells each having a plurality of weights with a selector for allowing the dumbbell to carry a desired number of weights;

(b) providing an elongated bar for use as a barbell, the bar having a receptacle at either end for receiving a selectorized dumbbell within the receptacle such that a selectorized dumbbell may be placed in the receptacle at either end of the bar;

(c) configuring each selectorized dumbbell in a first loaded condition having a desired number of weights;

(d) depositing each selectorized dumbbell as configured in step (c) into a receptacle; and (e) leaving at least a portion of each selectorized dumbbell in each receptacle to provide an exercise mass on each end of the bar.

27. The method of claim 26, wherein the leaving step comprises leaving the selectorized dumbbell in the first loaded condition thereof in its entirety in the receptacle such that the entire selectorized dumbbell forms the exercise mass.

28. The method of claim 26, wherein the leaving step comprises:

(a) placing the selector of the selectorized dumbbell into a position in which the dumbbell is adjusted into a second loaded condition in which the dumbbell carries fewer weights than in the first loaded condition, placement of the selector to provide the second loaded condition occurring after the selectorized dumbbell in the first loaded condition is deposited into the receptacle; and (b) removing the dumbbell in the second loaded condition from the receptacle to leave behind at least one weight in the receptacle such that the weights that are left behind in the receptacle provide the exercise mass.

* * * * *

UNITED STATES PATENT AND TRADEMARK OFFICE

CERTIFICATE OF CORRECTION

PATENT NO. : 7,201,711 B2
APPLICATION NO. : 10/367118
DATED : April 10, 2007
INVENTOR(S) : Carl K. Towley, III et al.

It is certified that error appears in the above-identified patent and that said Letters Patent is hereby corrected as shown below:

Col. 12, Line 50, change “the tree end” to --“the free end--;
Col. 13, Line 29, change “loined by a bottom wall” to --joined by a bottom wall--;
Col. 14, Line 25, change “Comprises” to --comprises--.

Signed and Sealed this

Fifth Day of June, 2007

JON W. DUDAS
*Director of the United States Patent and Trademark Office*